US011857011B2

(12) United States Patent
Solano et al.

(10) Patent No.: US 11,857,011 B2
(45) Date of Patent: Jan. 2, 2024

(54) OUTERWEAR SHAPEWEAR

(71) Applicant: Maddox Holdings, Inc., Holtsville, NY (US)

(72) Inventors: Yajaira Solano, Patchogue, NY (US); Bruce Moncada, Patchogue, NY (US)

(73) Assignee: Maddox Holdings, Inc., Oakland Park, FL (US)

( * ) Notice: Subject to any disclaimer, the term of this patent is extended or adjusted under 35 U.S.C. 154(b) by 360 days.

(21) Appl. No.: 16/879,746

(22) Filed: May 20, 2020

(65) Prior Publication Data

US 2021/0186132 A1 Jun. 24, 2021

Related U.S. Application Data

(63) Continuation-in-part of application No. 16/724,000, filed on Dec. 20, 2019, now Pat. No. 11,457,671.

(51) Int. Cl.

| | |
|---|---|
| ***A41D 7/00*** | (2006.01) |
| ***A41D 31/14*** | (2019.01) |
| ***A41D 1/22*** | (2018.01) |
| ***A41B 1/08*** | (2006.01) |

(52) U.S. Cl.

CPC ..... *A41D 7/00* (2013.01); *A41D 31/14* (2019.02); *A41B 1/08* (2013.01); *A41D 1/22* (2013.01); *A41D 2300/322* (2013.01); *A41D 2400/38* (2013.01); *A41D 2500/10* (2013.01); *A41D 2500/50* (2013.01)

(58) Field of Classification Search

CPC ..... A41D 2300/32; A41D 2500/10; A41D 2500/50; A41B 1/08

See application file for complete search history.

(56) References Cited

U.S. PATENT DOCUMENTS

| | | | | |
|---|---|---|---|---|
| 2,424,056 A | | 7/1947 | Ruth | |
| 2,583,865 A | * | 1/1952 | McIlhinney | A41D 7/00 450/8 |
| 2,629,996 A | | 3/1953 | Hamilton | |
| 3,245,409 A | | 4/1966 | Martin | |
| 3,338,071 A | * | 8/1967 | Pons | D04B 1/108 66/182 |

(Continued)

FOREIGN PATENT DOCUMENTS

| | | |
|---|---|---|
| BR | 2488183 A | 8/2012 |
| EP | 1136001 A1 | 9/2001 |

(Continued)

*Primary Examiner* — Jocelyn Bravo

(74) *Attorney, Agent, or Firm* — Alfred M. Walker

(57) ABSTRACT

An exercise body shaping garment suitable for gymnastics or other active use in general includes a top region and at least a plurality of compressive layers in a multi-layer compression abdominal region below the breasts. For a man or woman, a tee shirt is provided. For women, the outer or under wear garment has an opening in the crotch area and a pair of arm coverings which cover at least an over the shoulder clavicle area of the wearer, with optional spaghetti straps, tank tops, and sleeves short sleeves, half sleeves or full sleeves. For both a man or a woman, the abdominal compression area includes an inner skin contact first compressive porous layer capable of emitting body sweat therethrough and a second stronger compressive layer mesh layer and at least one sweat porous first compressive layer.

13 Claims, 11 Drawing Sheets

(56) References Cited

U.S. PATENT DOCUMENTS 3,362,029 A 1/1968 Comerma
3,375,829 A 4/1968 Brennan et al.
3,413,824 A 12/1968 Kuney
3,771,172 A * 11/1973 Barg ..... A41D 7/00 2/912
3,824,812 A * 7/1974 Matthews ..... D04B 1/243 2/409
3,909,851 A * 10/1975 Garrou ..... A41B 11/14 2/409
4,267,607 A 5/1981 Tino
4,654,894 A * 4/1987 Kudo ..... A41D 7/00 2/67
4,956,878 A * 9/1990 Boynton ..... A41D 7/00 450/11
5,054,129 A * 10/1991 Baehr ..... A41B 11/004 2/242
5,097,537 A 3/1992 Ewing
5,221,227 A * 6/1993 Michels ..... A41C 3/0057 450/21
5,746,068 A 5/1998 Popa et al.
5,787,732 A 8/1998 Perron et al.
5,870,777 A * 2/1999 Hans ..... A41D 1/089 2/249
5,888,118 A * 3/1999 Kishi ..... A41D 1/06 450/156
5,987,933 A * 11/1999 Metzler ..... D02G 3/328 57/226
6,263,510 B1 * 7/2001 Bay ..... A41D 27/28 2/93
6,276,176 B1 8/2001 Blakely
6,463,765 B2 10/2002 Blakely
6,481,383 B1 * 11/2002 Ross ..... A01K 13/006 2/456
6,581,212 B1 * 6/2003 Andresen ..... A41D 19/01511 2/2.5
6,735,779 B1 * 5/2004 Shrem ..... A61F 9/045 2/10
7,024,892 B2 4/2006 Blakely
7,081,036 B1 7/2006 Howard et al.
7,260,961 B1 * 8/2007 Kennedy ..... D04B 1/243 66/171
7,749,207 B2 * 7/2010 Rossi ..... A41D 31/185 604/385.07
8,196,220 B2 * 6/2012 Rance ..... A41D 7/00 2/69
8,425,275 B2 4/2013 Noel
8,550,088 B1 10/2013 Booher
9,474,308 B2 10/2016 Cronan
9,706,799 B1 * 7/2017 Butler ..... A41D 7/00
9,717,289 B1 * 8/2017 Fooden ..... A41D 7/00
9,801,420 B2 * 10/2017 Hays ..... A41D 1/06
9,867,400 B2 1/2018 Solano et al.
9,955,739 B2 5/2018 Melarti et al.
10,058,131 B2 8/2018 Solano et al.
10,463,530 B2 11/2019 Booher
11,246,361 B1 * 2/2022 Wimer-Golebiowski ..... A41D 1/22
11,419,369 B1 * 8/2022 Duke ..... A41D 31/245
11,457,673 B2 * 10/2022 Liu ..... A61F 5/026
2002/0007507 A1 1/2002 Duran
2003/0019014 A1 1/2003 Duran
2003/0110551 A1 6/2003 Lazarian
2004/0006811 A1 * 1/2004 McKenzie ..... A41B 11/14 2/240
2004/0049831 A1 * 3/2004 Smilovic ..... A41B 9/06 2/211
2004/0093657 A1 * 5/2004 Erinc ..... A41D 15/00 2/69
2004/0224603 A1 * 11/2004 Kaye ..... A41C 3/10 450/1
2005/0060792 A1 * 3/2005 Desai ..... A41B 9/00 2/403
2005/0064790 A1 * 3/2005 Mone ..... A41F 15/002 450/7
2006/0025039 A1 * 2/2006 Barbour ..... A41D 15/005 450/1
2006/0230488 A1 * 10/2006 Rudolph ..... A41D 1/086 2/69
2007/0022510 A1 * 2/2007 Chapuis ..... A41D 27/28 2/69
2009/0205096 A1 * 8/2009 Seemann ..... A41D 15/04 2/84
2009/0209172 A1 * 8/2009 Getz ..... A41C 1/06 450/86
2010/0011479 A1 * 1/2010 Onoda ..... A41D 13/02 2/67
2010/0011481 A1 * 1/2010 Kipnes ..... A41D 1/22 2/105
2010/0031415 A1 * 2/2010 Shadid ..... A41D 13/0012 2/87
2010/0107297 A1 * 5/2010 Brodbeck ..... A63B 21/0602 434/254
2011/0003533 A1 * 1/2011 Caruso ..... A41B 9/06 450/11
2011/0009793 A1 * 1/2011 Lucero ..... A41D 13/0015 602/61
2011/0214216 A1 * 9/2011 Zarabi ..... A41F 9/00 2/69
2011/0225696 A1 * 9/2011 Di Lorenzo ..... A41D 7/00 2/67
2011/0289648 A1 12/2011 Burke
2012/0036616 A1 2/2012 Miyasaka
2012/0129425 A1 * 5/2012 Bevans ..... A41D 1/06 450/11
2012/0131719 A1 * 5/2012 Diamant ..... A41B 9/02 2/69
2012/0185992 A1 * 7/2012 Byrnes ..... A41D 7/00 2/67
2012/0196508 A1 * 8/2012 Anvaripour ..... A41C 1/003 450/154
2013/0095730 A1 * 4/2013 Jensen ..... A41D 1/06 450/95
2013/0305428 A1 * 11/2013 Rendon ..... A45C 11/16 2/74
2014/0057530 A1 * 2/2014 Mazourik ..... A41C 1/02 450/100
2014/0090142 A1 * 4/2014 Waller ..... A41D 13/0015 2/67
2014/0273741 A1 * 9/2014 Hays ..... A41D 1/06 450/156
2014/0317826 A1 * 10/2014 Decker ..... A41D 13/0015 2/69
2015/0201682 A1 * 7/2015 Musciacchio ..... A41D 7/005 2/67
2016/0150832 A1 6/2016 Solano et al.
2016/0324221 A1 * 11/2016 Wilson ..... A41C 3/0021
2017/0164668 A1 * 6/2017 Bersamin ..... A41D 27/201
2017/0295859 A1 * 10/2017 Butler ..... A41D 31/02
2017/0296359 A1 * 10/2017 Conway ..... A41C 3/08
2017/0318864 A1 * 11/2017 Carroll ..... A41B 9/04
2017/0318881 A1 * 11/2017 Fonte ..... A41D 31/14
2017/0325516 A1 * 11/2017 Oborina ..... A41C 3/0007
2018/0084842 A1 * 3/2018 Pham Johnson ..... A41D 1/21
2019/0029345 A1 * 1/2019 Marchetto ..... A41D 27/24
2019/0045855 A1 * 2/2019 Musciacchio ..... A41D 7/005
2019/0059465 A1 * 2/2019 Zimmer ..... A41D 7/00
2019/0075853 A1 * 3/2019 Altmann ..... D04B 1/104
2019/0116898 A1 * 4/2019 Ulrich ..... A41C 3/08
2019/0246717 A1 * 8/2019 Fischer ..... A41D 27/00
2019/0297959 A1 * 10/2019 Liu ..... A61F 5/026
2019/0320747 A1 * 10/2019 Otashevich ..... A41D 31/04
2020/0085115 A1 * 3/2020 Roberts Johnson ..... A41B 9/06
2020/0120999 A1 * 4/2020 Mason ..... A41C 1/02
2020/0205485 A1 * 7/2020 Frankenbach ..... D03D 15/56
2021/0052020 A1 * 2/2021 Snyder ..... A41C 3/122
2021/0153573 A1 * 5/2021 Shams ..... A41D 7/00
2021/0329983 A1 * 10/2021 Strobel ..... A41D 7/00

(56) References Cited

U.S. PATENT DOCUMENTS

| | | | | |
|---|---|---|---|---|
| 2021/0386151 | A1* | 12/2021 | Blakely | A42B 1/22 |
| 2022/0256955 | A1* | 8/2022 | Shams | A41D 7/00 |
| 2022/0287391 | A1* | 9/2022 | Segar | A41D 31/02 |

FOREIGN PATENT DOCUMENTS

| | | | |
|---|---|---|---|
| EP | 20203290.0-1017 | | 4/2021 |
| GB | 1514100 | A1 | 6/1978 |
| GB | 2016753.2 | | 4/2021 |
| WO | WO98-44813 | A1 | 10/1998 |
| WO | WO2012/109474 | A1 | 8/2012 |
| WO | PCT/US2014069344 | A | 3/2015 |
| WO | WO2015089071 | A1 | 6/2015 |

* cited by examiner

OUTERWEAR SHAPEWEAR

RELATED APPLICATIONS

This application is a continuation-in-part of application Ser. No. 16/724,000 filed Dec. 20, 2019 and claims priority in part therefrom under 35 USC § 120.

FIELD OF THE INVENTION

The present invention relates to compressive breathable body shaping outerwear garments.

BACKGROUND OF THE INVENTION

The body-shaping garments for both men and women of this invention are for use as outerwear or as partially covered active wear. Using stretch fabric panels, body shape is enhanced while activity (as in exercise) is supported through selective compression.

The prior art reveals some garments which have similar objectives. U.S. Pat. No. 10,058,133 of Solano is for a butt enhancing undergarment offering limited compression of certain body regions in an undergarment.

The body-shaping garment of Melarti, et al., U.S. Pat. No. 9,955,739, describes a woman's garment compressing a portion of the mid-section of a wearer above the waist. This upper part is attached to a lower portion of the garment at a seam. The lower portion may include panties with optional skirt.

The body-shaping intimacy garment described in U.S. Pat. No. 9,474,308 of Cronan is a woman's garment in two layers. The inner layer is stretched over the torso, waist, buttocks, hips and legs. The outer layer is of lower elasticity than the inner layer and is attached to the inner layer only at the bust.

US Patent Application Number 2012/0129425 of Bevans is a woman's shapewear garment in two layers which are attached as a shell and a lining. The garment may be a dress, a jumper, a romper, a top, pants, shorts, or skirt. Compression is obtained by using elastic fabric in all parts of the garment.

U.S. Pat. No. 7,024,892 of Blakely for a woman's two-ply body-smoothing lower-body undergarment is made by circularly knitting a pair of fabric tubes.

U.S. Pat. No. 5,746,068 of Popa, et al., describes a method of using a circular knitting machine to integrally knit a two-layer lower body garment.

SUMMARY OF THE INVENTION

Using breathable knit fabrics with two or preferably, three, multilayers primarily in the abdomen area below the breasts (male and female), these garments thereby avoid uncomfortable compression of the chest area and they do not restrict any clavicle, arm or shoulder movements during exercise. Compressing the abdominal area has an aesthetic component to smooth and hold flab in as well as a physiological component to preventing sagging skin when some body weight is lost during exercise while not restricting breathing.

For women, one garment is a body suit (similar to a one-piece bathing suit) with a triple layer abdominal area. The body suit can be worn both an outer garment, or inside other clothes, as an undergarment. The body suit can also be manufactured and worn as a bathing swimsuit, with sun and chlorine resistant water adaptive materials. The first outer layer is the outer portion of the whole garment itself made up of a first compressive sweat-porous layer, while the second middle layer is a second stronger compressive mesh layer in the abdominal area, capable of being compressive and also being porous, to allow sweat to soak therethrough, so that the garment is "breathable", unlike compressive non-breathable neoprene type non-porous materials. The third inner skin connecting layer is also a first compressive sweat-porous layer. The rear back portions of the garment can be a single layer, a double layer or all three. The parts can be tube formed, but the multilayers are glued, sewn or zippered in place.

For the woman's body suit, the outer layer of the entire garment is preferably made of about 90% nylon and 10% LYCRA® knit, but if there are multi-colored patterns, (stripes, leopard skin, etc.) it will be instead knitted in a knit of about 84% polyester and about 16% LYCRA® because they hold multiple colors better than the nylon/LYCRA® composition. The range of weight for the outer layer is about 100 to 250 grams per square meter (GSM), preferably about 180 GSM.

In the body suit, the innermost first compressive sweat-porous layer, of the multilayers, touching the skin has a weight of about 150 to 400 grams per square meter (GSM), preferably about 330 GSM. This area, starting below the breast area is made of a knit of about 65% nylon and about 35% LYCRA®. The middle second stronger compressive layer of the multiple layers is a second stronger compressive, but sweat porous mesh, preferably known as "POWER NET"® mesh, although other meshes can be used. Latex is to be avoided however, since it is known to harbor bacteria and is allergenic to some people. POWER NET® is a textured stretch fabric with tiny holes; it is highly breathable and allows sweat therethrough to the outer layer. It has a weight of preferably about 230 to 250 GSM; instead of the nylon/LYCRA® composition of the other layers, it is about 92% polyester (i.e., a polyamide) and about 8% nylon. The rear back portion of the garment can be three layers, like the front portion (abdominal wrapping around the back) or it can be two layered with the outer layer of about 180 GSM and an inner layer of about 330 GSM but optionally no compressive POWER NET® mesh inner layer. If the rear back portion is one layer it will be more compressible at a weight of about 330 GSM. Other women's garments of this invention are described in the detailed description.

The POWER NET® mesh has a range of sizes for the holes in the mesh, but the holes are porous to permit sweat to pour through. The mesh holes are large enough to provide "breathability" that allow body heat and sweat through the tiny mesh holes. There is therefore a relationship between mesh hole size and the ability to vent sweat.

There is another metric which relates hole size to amount of stretch of the power mesh. The materials have a wicking function which is related to fluid dynamics. When the hole dimensions are small, the fibers may be coated or uncoated (hydrophilic or hydrophobic).

While dimensions may vary, preferably the holes in the second stronger compressive mesh layer are about 0.25 mm in diameter size. The 0.25 mm holes can go down in size to almost 0.20 mm or up to about 30 mm in size, so that the holes have a diameter in a range of from about 0.20 mm up to 0.30 mm, preferably about 0.25 mm.

In a man's garment, made of similar layers as the woman's garment, there is provided an open bottomed knitted tee shirt, or other shirt, which is provided with an open bottomed edge, above which is the "below breast" multilayer abdominal area, similar to the abdominal area of the woman's one piece knitted suit garment. The man's or woman's shirt, which can be a tee shirt with short sleeves, or a long-sleeved, or partial sleeved shirt, or tank top with straps, has the same composition of fabrics and multi-layers as the woman's body suit. The main skin-touching abdominal part is about 65% nylon and 35% LYCRA® at a weight of preferably about 330 GSM; but the rear back portion can be provided in a weight of about 180 GSM in one layer and about 330 GSM in another layer, or in combinations of ranges between about 180 GSM and about 330 GSM thereof. The man's or woman's tee shirt also has a similar abdominal layer of sweat porous second stronger compressive mesh, preferably POWER NET® mesh having a weight of about 230 GSM in the middle and about 330 GSM in the skin-touching innermost layer.

To summarize, the present invention includes both a multi-layer exercise tee shirt for men (or women) and a multi-layer woman's body suit garment.

The man's or woman's shirt, such as a tee shirt, includes an upper area with short, partial-length or full-length sleeves or tank top straps, comprising a layer of knitted fabric made from a mixture of nylon and LYCRA having a weight of about 330 GSM®; and a lower compression abdominal area comprising three layers of knitted fabric, including a middle layer comprised of second stronger compressive but sweat porous mesh fabric and first compressive and sweat porous inner and outer layers of a mixture of nylon and LYCRA®, each having a weight of about 330 GSM.

The tee shirt therefore includes an abdominal area including an inner skin contact first compressive porous layer capable of emitting body sweat therethrough, a middle second stronger compressive layer comprising a textured porous compressive mesh layer and an outer sweat porous first compressive layer. Optimally, a side zipper may be provided for opening the compression abdominal area to allow for ease of donning and removing the tee shirt, or the compressive layers can be secured in place by being glued, sewn or otherwise attached.

The inner and outer first compressive layers of the tee shirt are made of about 65% nylon and 35% LYCRA®, and the porous, second stronger compressive mesh layer is about 92.5/8 polyester/nylon, and, while other mesh materials may be used, preferably the aforementioned mesh fabric is POWER NET®.

A woman's exercise body shaping romper garment includes a top region of knitted fabric, and a three-layer compression abdominal region below breasts of a wearer comprising a mixture of polyester and LYCRA® knitted fabric, and preferably having a single layer knitted fabric back region below which is a compression region adjacent a crotch of the garment. The compression sweat porous abdominal region includes an inner skin contact first compressive layer capable of emitting body sweat therethrough, a middle second stronger compressive layer comprising a textured porous second stronger compressive mesh layer and an outer sweat porous first compressive layer.

Preferably, the exercise body shaping romper garment includes an outer layer comprised of about 84% polyester and 16% LYCRA®. Also, preferably, the porous, second stronger compressive mesh layer is about 92.5/8 polyester/nylon, and, while other mesh materials may be used, preferably the aforementioned mesh fabric is POWER NET®.

The present invention for outerwear garments for men or women includes wearable copper fabrics, mixed with elastane, nylon, spandex and/or any flexible fabric or thread to make it more flexible and wearable. The wearable copper fabrics are a combination of copper or silver plated yarn which is knitted or woven with various non-conductive yarns. While any copper based fabrics may be used, preferably the garment's copper fabrics are derived from the Silverell® line of fabrics, which are used for anti-microbial, fungicidal, RF shielding and/or thermal therapeutic applications in the outerwear garments.

In general, the breathable body shaper garment of a man's or woman's shirt or a woman's exercise shapewear garment includes an integral top, abdominal compression area, optional skirt/shorts/pants of knitted fabric (for a woman's exercise shapewear garment); and an abdominal compression area below the breasts of the wearer including a plurality of at least two layers of a textured sweat porous second stronger compressive mesh fabric and at least one sweat porous first compressive layer. Preferably, the at least two layers includes three or more layers, including at least an inner skin contact first compressive porous layer capable of emitting body sweat therethrough, a middle second stronger compressive layer comprising a textured porous second stronger compressive mesh layer and at least an outer sweat porous first compressive layer.

BRIEF DESCRIPTION OF THE DRAWINGS

The present invention can best be understood in connection with the accompanying drawings. It is noted that the invention is not limited to the precise embodiments shown in the following drawings, in which.

DETAILED DESCRIPTION OF THE FIGURES

The Figures presented here represent a small sampling of the variety of garments for both men and women that are possible to be produced as both outerwear and undergarments with the features of this invention. All garments are constructed of breathable sweat-wicking material using seamless WKS or similar knitting techniques with compression in the abdominal area.

Figure 1:
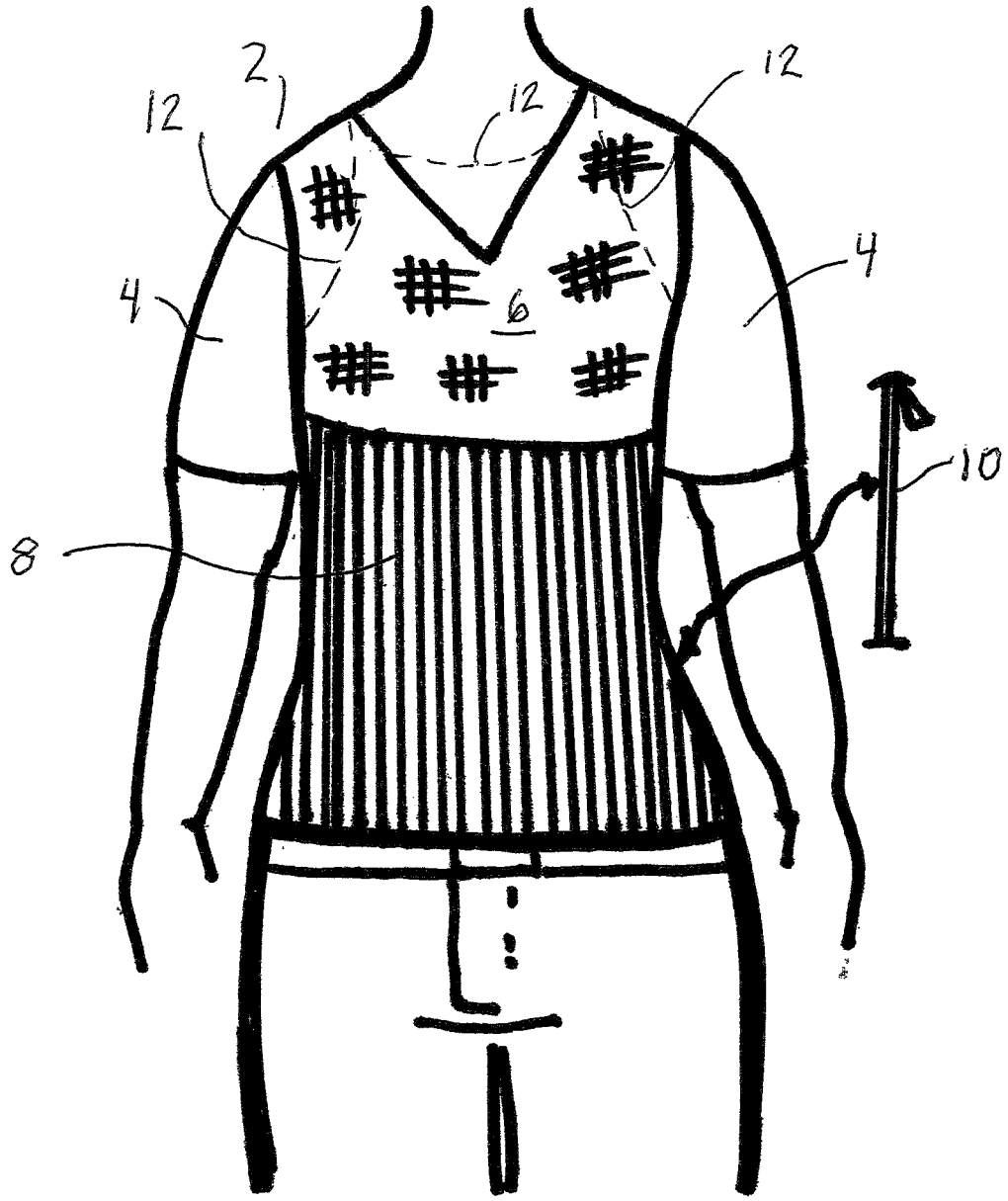
FIG. 1 is a front elevation of a man's or woman's tee shirt of this invention.
Figure 2:
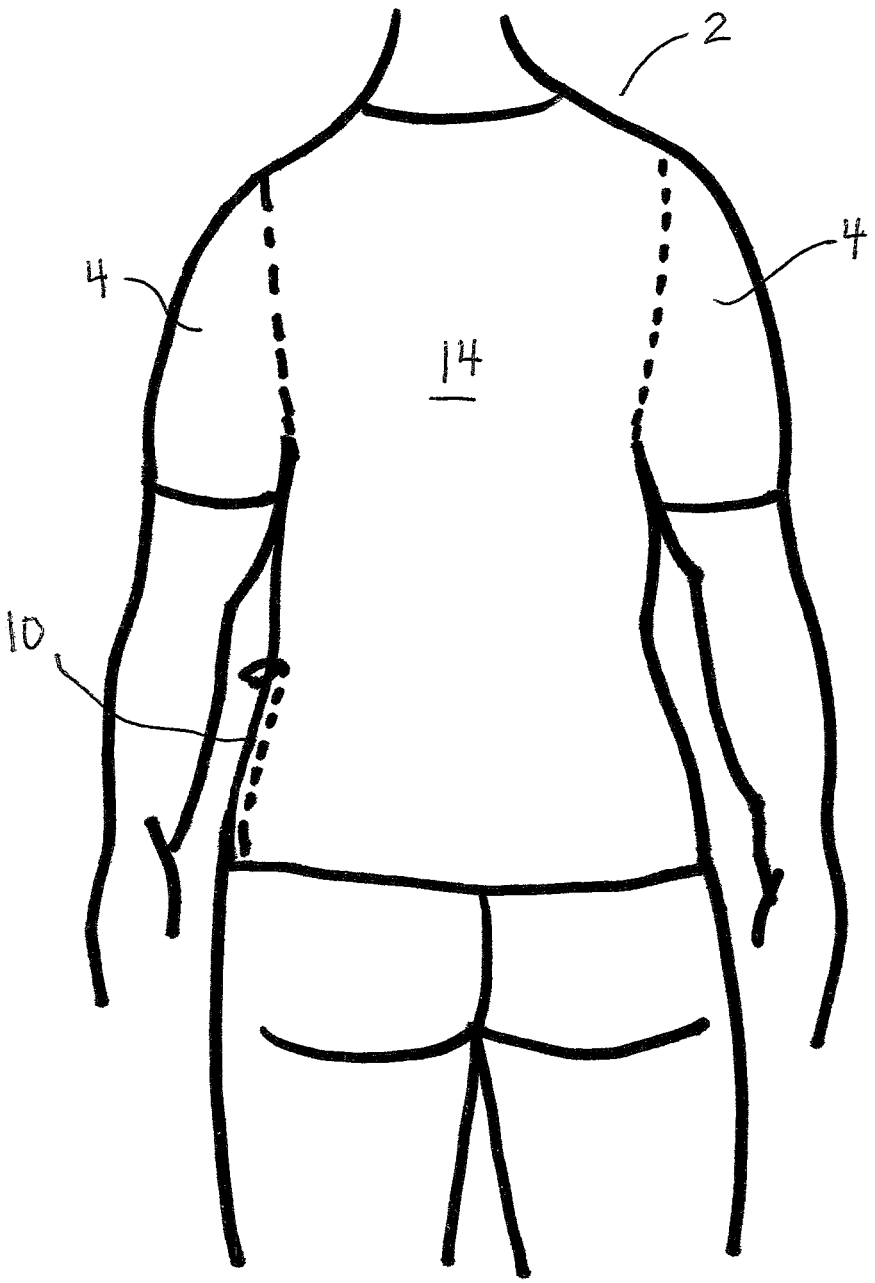
FIG. 2 is a back elevation of the shirt of FIG. 1.
Figure 3:
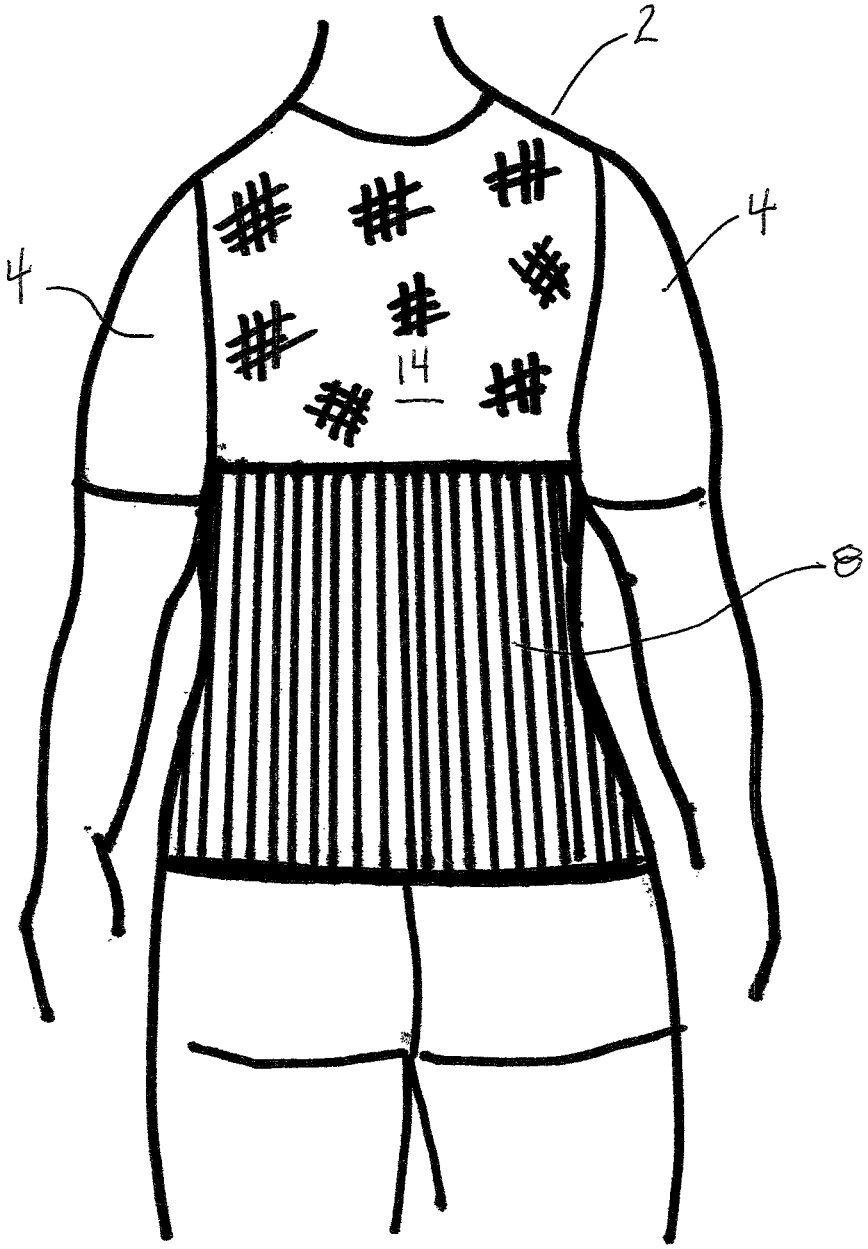
FIG. 3 is a rear view of another embodiment for a man's or woman's tee shirt.

FIG. 1 shows the front of a man's or woman's tee shirt 2 with short sleeves 4, side zipper 10, lower compression area 8, and upper region 6. Dashed outlines 12 show the alternative embodiment as a tank top. Zipper 10 is used for ease of donning because of the compression region 8. FIGS. 2 and 3 show the back of tee shirt 2 with back panel 14. Top region 6, sleeves 4 (if used), and back 14 are 330 GSM 65% nylon/35% LYCRA®. Region 8 compression area consists of three layers, outer layer is the same as the top and back, inner layer (skin contact) is also the same 330 GSM 65/35 nylon/LYCRA®, the middle layer is POWER NET® mesh 92.5/8 polyester/nylon. The abdominal compression area 8 includes an inner skin contact first compressive porous layer capable of emitting body sweat therethrough, a middle second stronger compressive layer comprising a textured porous second stronger compressive mesh layer and an outer sweat porous first compressive layer. The difference between FIGS. 2 and 3 is that FIG. 2 shows the zipper 10 for insertion of the second stronger compressive mesh layer 8 into a pocket of the tee shirt garment 2, but FIG. 3 shows where the second stronger compressive layer 8 is sewn into the tee shirt 2 in the abdominal region thereof. The man's or woman's tee short can also be a sleeveless tank top or a full or partial length sleeved tee shirt.

Figure 4:
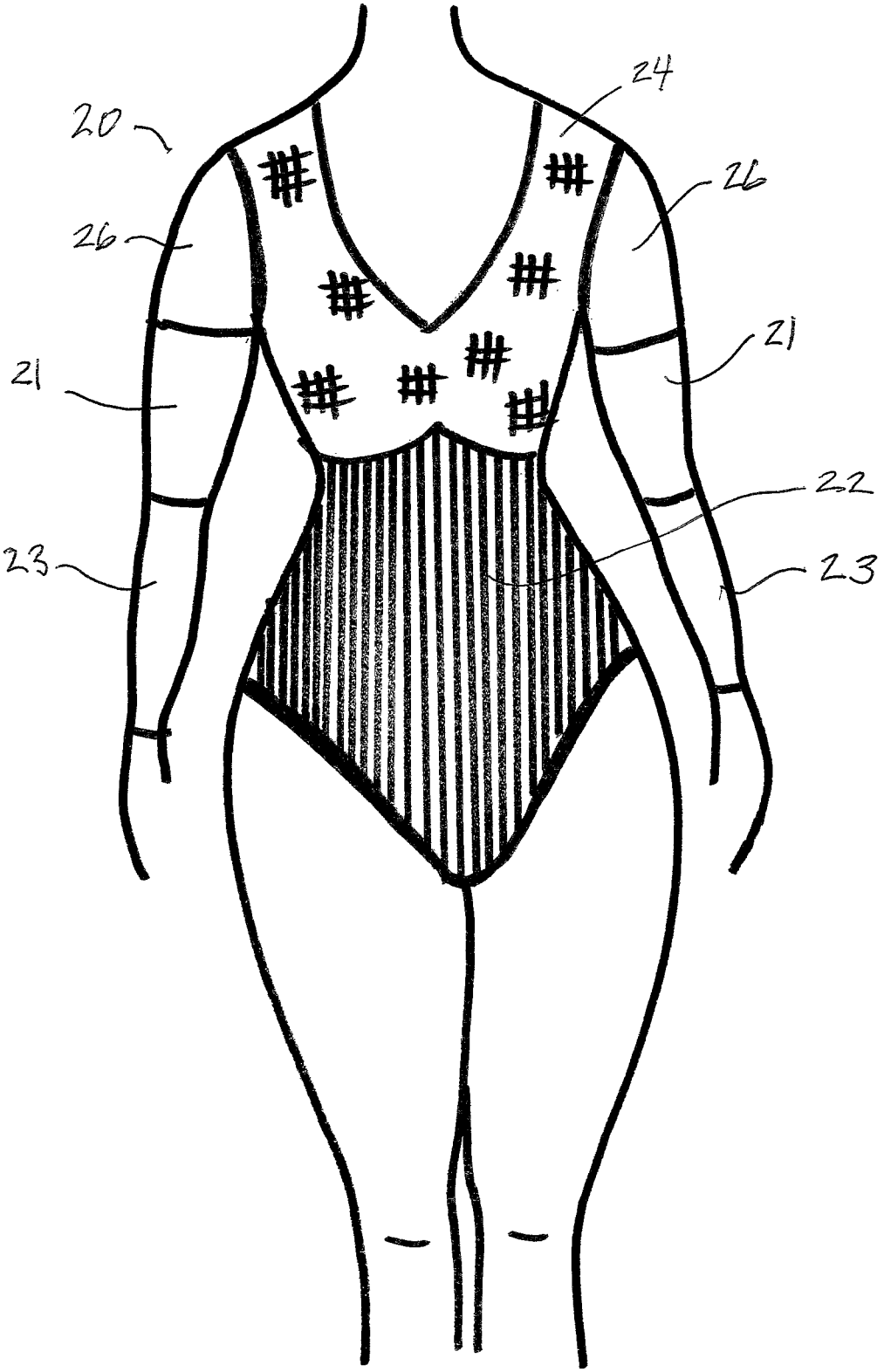
FIG. 4 is a front elevation of a women's exercise body shaping romper suit garment.
Figure 5:
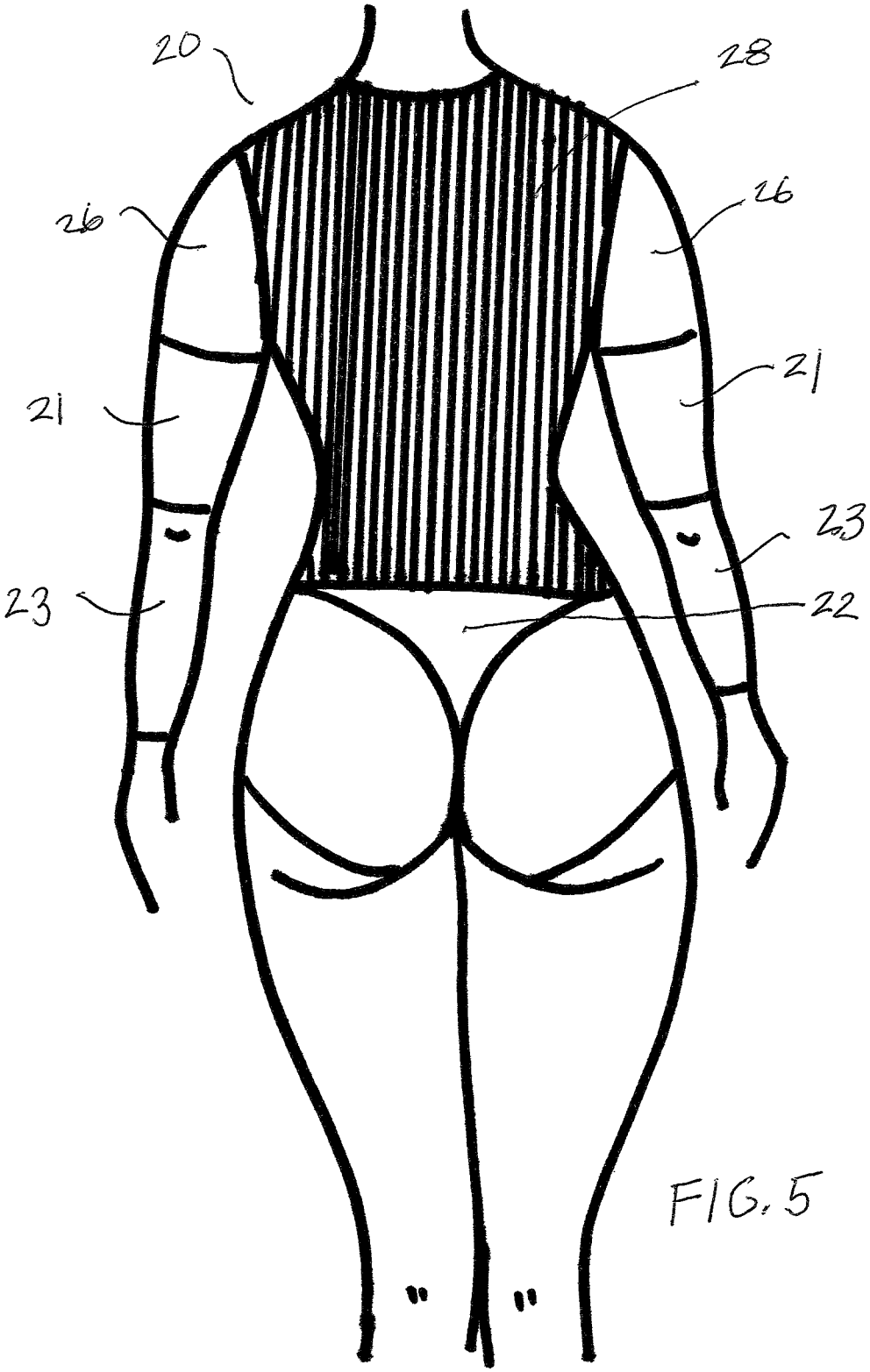
FIG. 5 is a back elevation of the garment of FIG. 3.
Figure 11:
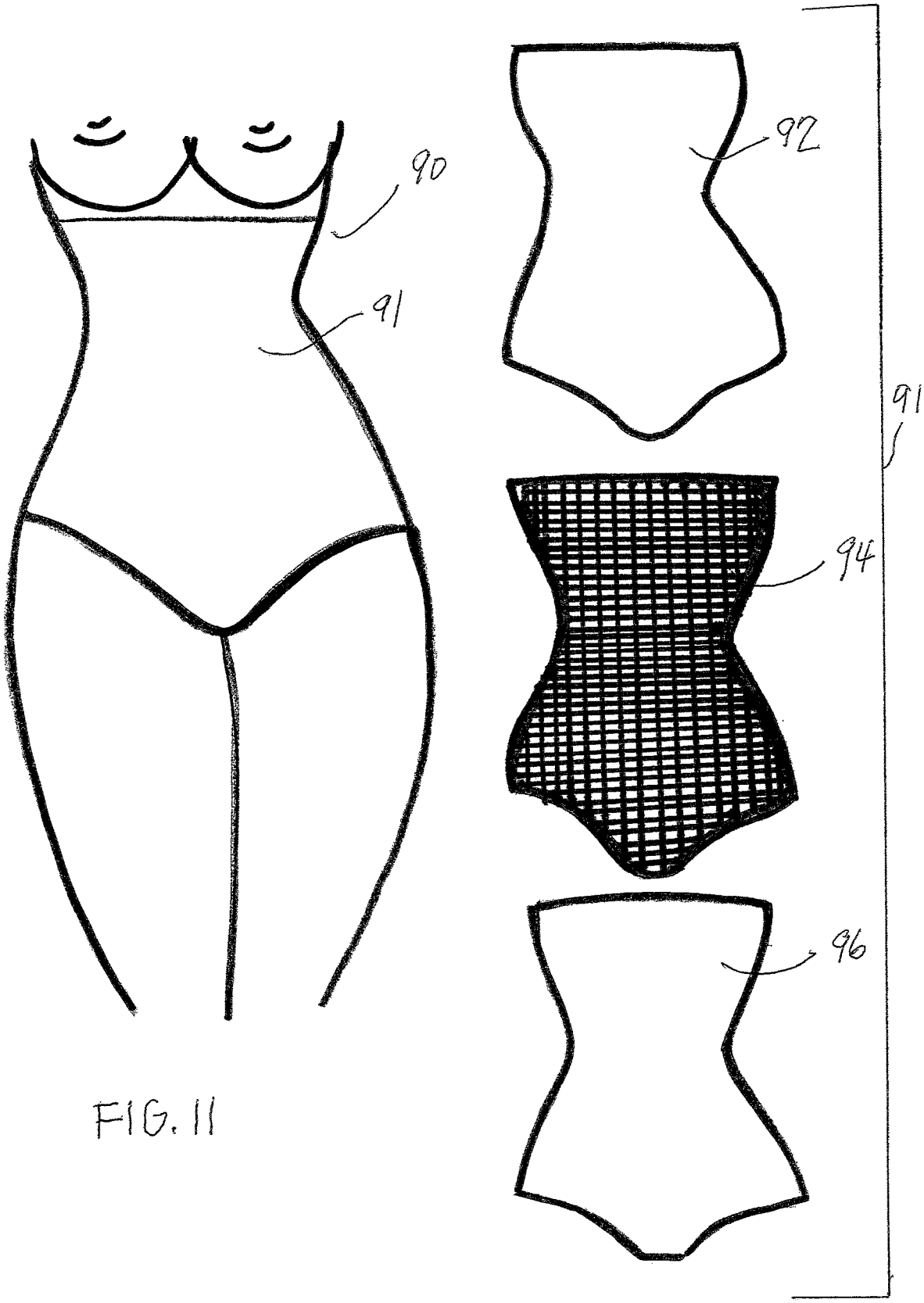
FIG. 11 is an exploded detail view of the torso portion of any of the woman's garments, shown with a first outer first compressive porous layer, a mid-second stronger compressive porous mesh layer and an inside first compressive porous layer to be placed adjacent to the wearer's skin.

FIGS. 4 and 5 illustrate an exercise body shaping romper garment suitable for gymnastics or gym use in general. It can be paired with bottom covering shorts, pants or skirt for use as active wear. In FIG. 3, garment 20 has a top region 24 and a three-layer compression abdominal region 22 (below the breasts). It has snaps in the crotch area (not shown). Although shown as short sleeves 26, half sleeve 21 and full sleeve 23 extents are indicated. Since a bright pattern is used, the outer layer is 84% polyester and 16% LYCRA® because this holds color and patterns better than a 90% nylon and 10% LYCRA®. In FIG. 4, double back 28 panel is shown. A single layer fabric back region (not shown) may be provided below the compression zone and adjacent to the crotch. The abdominal compression area 22 includes three layers, such as shown in FIG. 11, including an inner skin contact first compressive porous layer capable of emitting body sweat therethrough, a middle second stronger compressive layer comprising a textured porous second stronger compressive mesh layer and an outer sweat porous first compressive layer. The garment can cover at least a shoulder clavicle area of the wearer, with optional spaghetti straps, tank top straps. short sleeves, half sleeves, partial length sleeves or full-length sleeves.

Figure 6:
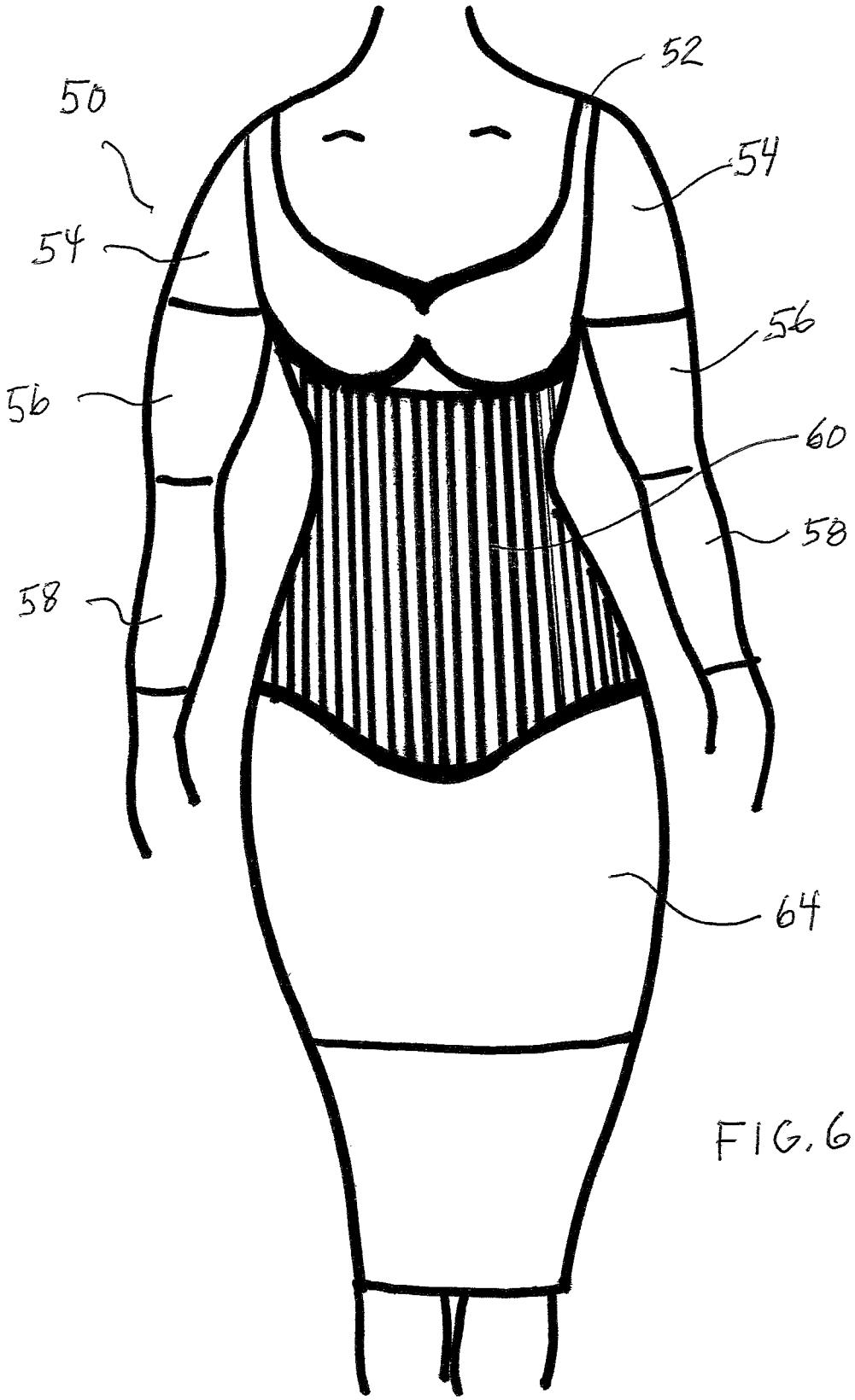
FIG. 6 is a front elevation of a woman's garment showing the use of a modesty skirt over the lower part.
Figure 7:
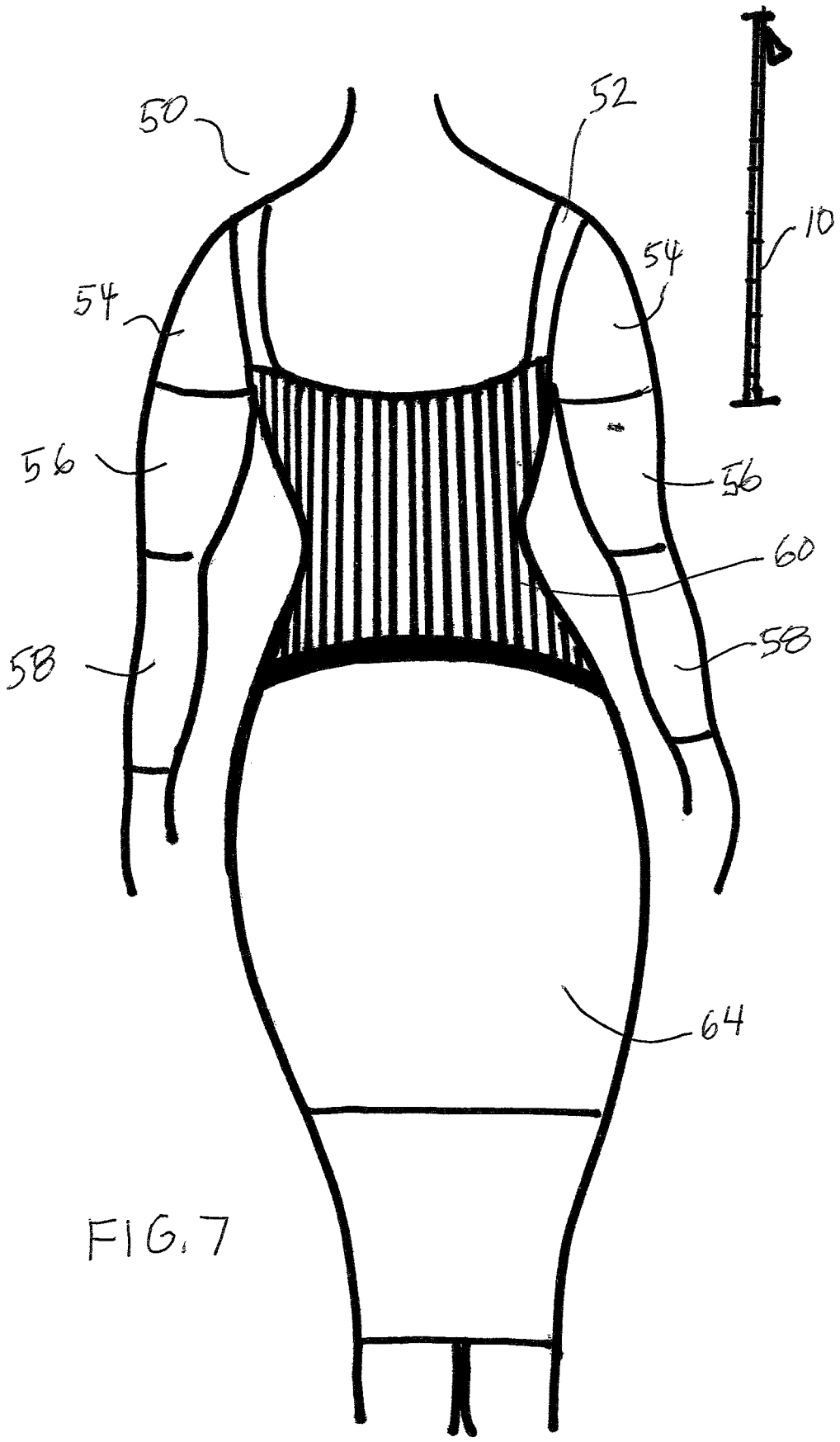
FIG. 7 is a rear view of the woman's garment of FIG. 6.

FIGS. 6 and 7 show front and rear views of a body shaper garment 50 with an integral top 51 and a modesty skirt 64. A triple layer abdominal region 60 compresses the tummy below the breasts. As shown, it is a sleeveless tank 52, but short sleeve 54, mid sleeve 56 and long sleeve 58 lengths are also shown. Since the garment itself 50 can be a body suit with crotch wide gusset for bathroom use, as shown in FIGS. 6 and 7, a lower covering is required for use as outerwear. Skirt 64 can be replaced by shorts or pants. The abdominal compression area 60 includes an inner skin contact first compressive porous layer capable of emitting body sweat therethrough, a middle second stronger compressive layer comprising a textured porous second stronger compressive mesh layer and an outer sweat porous first compressive layer. FIG. 7 shows the optional zipper 10 for insertion of the second stronger compressive mesh layer 8 into a pocket of the body shaper garment 50.

Figure 8:
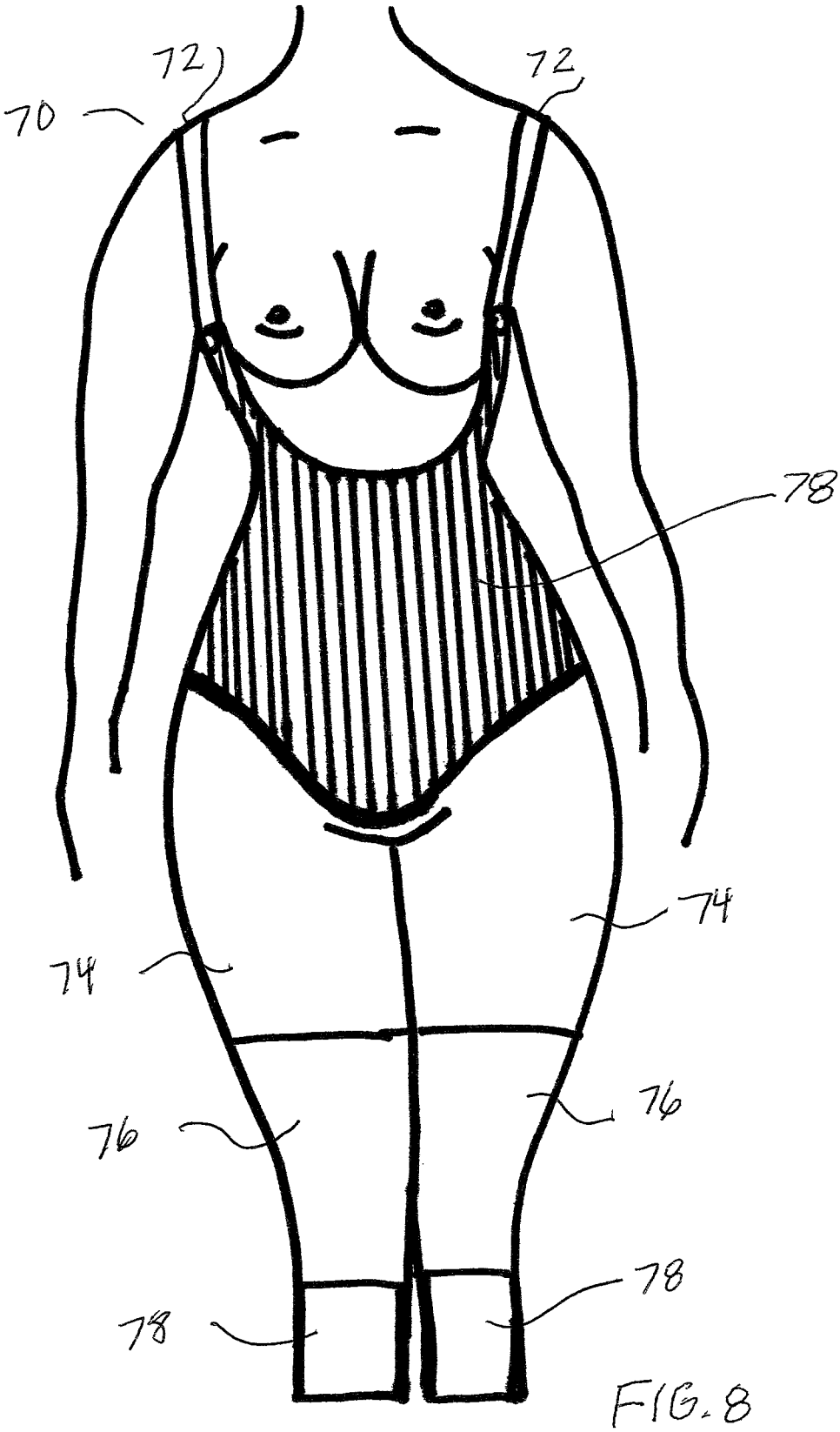
FIG. 8 is a front elevation of an alternate embodiment for a woman's garment with a halter top portion thereof.
Figure 9:
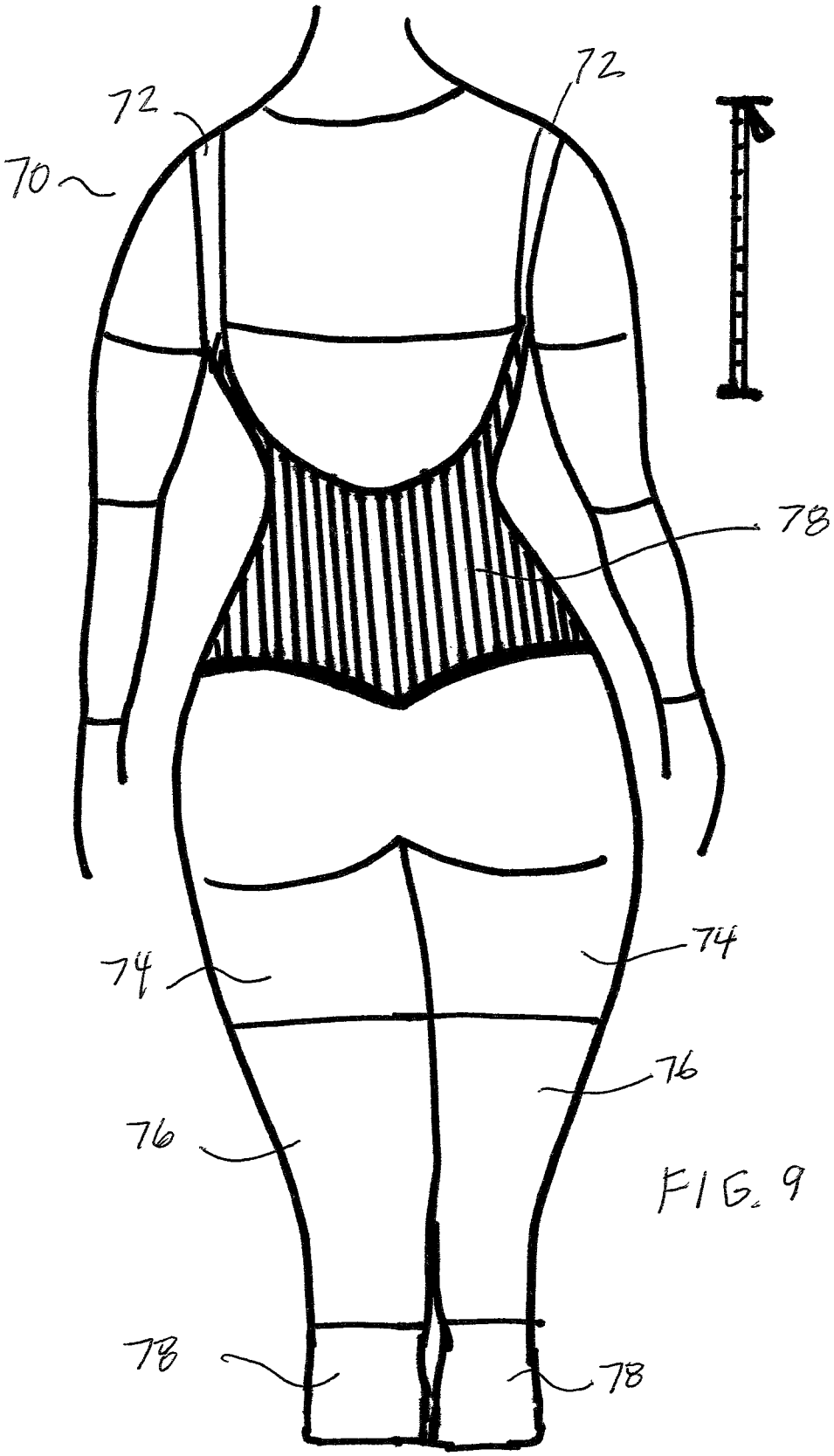
FIG. 9 is a rear view of the halter top garment of FIG. 8.

FIGS. 8 and 9 show an alternate embodiment for front and rear views of a woman's garment 70 with a compressive triple layer abdominal portion 78 and a sleeveless strap top portion 72 thereof, where the breasts are exposed and are covered with an outer blouse or shirt (not shown). Variable length leg covering portions are shown, including mid-thigh length portions 74, knee length portions 76 and below the knee length portions 78.

Figure 10:
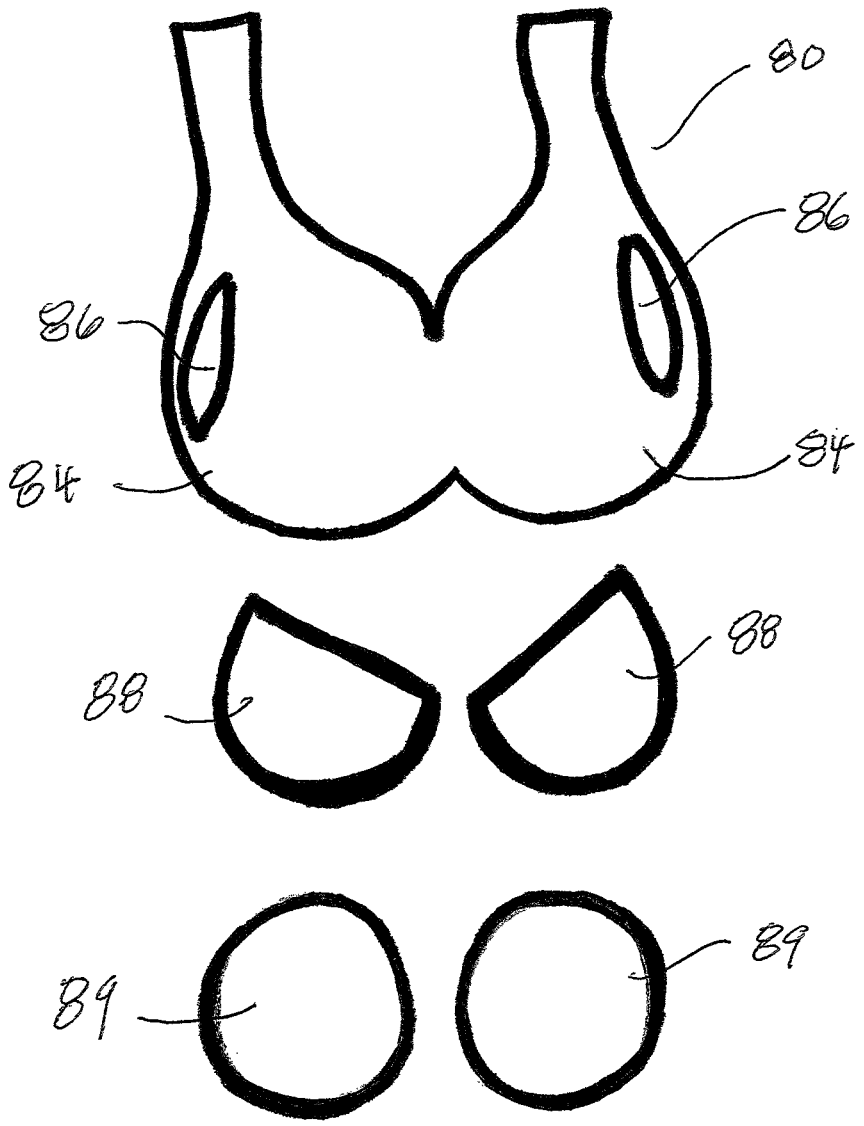
FIG. 10 is an exploded detail view of an alternate brassiere to be used with any of the aforementioned woman's garment, with slots for insertion of silicone or other synthetic breast inserts or implants.

FIG. 10 shows an alternate brassiere 80 to be used with any of the aforementioned woman's garments 20, 50 or 70, with pockets 84 having slots 86 for insertion of silicone or other synthetic breast inserts or implants 88 or 89 therein.

In conclusion, FIG. 11 shows the torso portion 91 of a woman's garment 90, shown with the torso portion 91 (below the breasts) having first outer first compressive porous layer 92, a middle second stronger compressive porous mesh layer 94 and an inside first compressive porous layer 96, (shown in a bracket for the torso portion 91 in an exploded view) to be placed adjacent to the wearer's skin. The other woman's garments 20, 50 and 70 shown in drawing FIGS. 4 and 5, 6 and 7, as well as 8 and 9, respectively, also have three layer abdominal portions similar to abdominal portion 91 of FIG. 11, with first outer first compressive porous layer 92, a middle second stronger compressive porous mesh layer 94 and an inside first compressive porous layer 96 to be placed adjacent to the wearer's skin.

The man's or woman's tee shirt 2 of FIGS. 1, 2 and 3 can also have three layer compressive abdominal portion 8, similar to abdominal portion 91 of the woman's garment 90 shown in FIG. 11, also having first outer first compressive porous layer 92, a middle second stronger compressive porous mesh layer 94 and an inside first compressive porous layer 96 to be placed adjacent to the wearer's skin.

In the foregoing description, certain terms and visual depictions are used to illustrate the preferred embodiment. However, no unnecessary limitations are to be construed by the terms used or illustrations depicted beyond what is shown in the prior art, since the teams and illustrations are exemplary only, and are not meant to limit the scope of the present invention.

We claim:

1. A breathable exercise body shaping woman's romper garment comprising:

a top region of knitted fabric;

a lower compression abdominal area consisting of three layers including:

an inner compressive layer configured to contact a wearer's skin and having a weight of about 150 to 400 grams per square meter, a middle compressive layer comprising a textured porous compressive mesh stretch fabric, and an outer compressive layer;

wherein the inner, middle and outer compressive layers are each porous and configured to emit body sweat therethrough; and wherein the middle compressive layer provides a higher level of compression than the inner compressive layer and the outer compressive layer, all of said inner, middle and said outer compressive layers being attached in place.

2. The breathable exercise body shaping woman's romper garment as in claim 1 wherein said textured porous compressive mesh stretch fabric of said middle compressive layer comprises a knitted fabric comprising a mixture of polyester and spandex.

3. The breathable exercise body shaping woman's romper garment of claim 1 having a single layer knitted fabric back region and a compression region extending below the single layer knitted fabric region and located adjacent a crotch of said garment.

4. The breathable exercise body shaping woman's romper garment of claim 1 wherein said outer compressive layer comprises a knitted fabric comprising about 84% polyester and 16% spandex.

5. The breathable exercise body shaping woman's romper garment as in claim 1 wherein said mesh fabric has holes provided in a range of from about 0.20 mm to about 0.30 mm in diameter.

6. The breathable exercise body shaping woman's romper garment as in claim 1 wherein said mesh fabric has holes provided with a size of about 0.25 mm in diameter.

7. The breathable exercise body shaping woman's romper garment as in claim 1 wherein said garment is worn as an outerwear garment.

8. The breathable exercise body shaping woman's romper garment as in claim 1 wherein said garment is worn as an undergarment.

9. The exercise body shaping woman's romper garment as in claim 1 wherein said garment is worn as a bathing swimsuit.

10. The exercise body shaping woman's romper garment as in claim 9 wherein said bathing swimsuit is sun and chlorine resistant.

11. The exercised body shaping woman's romper garment as in claim 1 further comprising a pair of arm coverings selected from the group consisting of spaghetti straps, tank top straps, short length sleeves, partial length sleeves, half-length sleeves and full-length sleeves.

12. The exercise body shaping woman's romper garment as in claim 1 further comprising a brassiere with pockets having slots for insertion of silicone or other synthetic breast inserts or implants therein.

13. The breathable exercise body shaping woman's romper garment as in claim 1 further comprising a side zipper for opening said lower compression abdominal area to allow for ease of donning and removing said breathable exercise body shaping woman's romper garment.

* * * * *